US007379026B2

(12) United States Patent
Usui et al.

(10) Patent No.: US 7,379,026 B2
(45) Date of Patent: May 27, 2008

(54) ELECTRONIC DEVICE WITH ANTENNA, ANTENNA STRUCTURE, AND METHOD FOR ADJUSTING ANTENNA OR ELECTRONIC DEVICE

(75) Inventors: Hideyuki Usui, Chigasaki (JP); Hiroaki Agata, Yokohama (JP)

(73) Assignee: Lenovo Pte. Ltd., Singapore (SG)

( * ) Notice: Subject to any disclaimer, the term of this patent is extended or adjusted under 35 U.S.C. 154(b) by 0 days.

(21) Appl. No.: 11/169,536

(22) Filed: Jun. 28, 2005

(65) Prior Publication Data

US 2006/0001580 A1 Jan. 5, 2006

(30) Foreign Application Priority Data

Jul. 2, 2004 (JP) ..... 2004-196728

(51) Int. Cl.
*H01Q 1/24* (2006.01)

(52) U.S. Cl. ..... 343/702; 343/700 MS

(58) Field of Classification Search ..... 343/702, 343/700 MS, 829, 846
See application file for complete search history.

(56) References Cited

U.S. PATENT DOCUMENTS 6,437,747 B1 * 8/2002 Stoiljkovic et al. ..... 343/702
6,967,623 B2 * 11/2005 Hirota ..... 343/702
2002/0021251 A1 * 2/2002 Honda ..... 343/702

FOREIGN PATENT DOCUMENTS

| | | |
|---|---|---|
| JP | 61-143316 | 9/1986 |
| JP | 05-145328 | 6/1993 |
| JP | 7-20711 | 4/1995 |
| JP | 07-094932 | 4/1995 |
| JP | 07-176945 | 7/1995 |
| JP | 08-204438 | 8/1996 |
| JP | 2000-269728 | 9/2000 |
| JP | 2003-037416 | 2/2003 |
| JP | 2004-040154 | 2/2004 |

* cited by examiner

*Primary Examiner*—Tho G Phan
(74) *Attorney, Agent, or Firm*—Sawyer Law Group LLP

(57) ABSTRACT

The electronic device includes a device body, a radiation element for performing reception and/or radiation of electromagnetic wave as an antenna to be equipped with the device body, and a dielectric member placed close to or in contact with the radiation element within the device body, the dielectric member being movable from the outside of the device body to shift the resonance frequency of the antenna. According to the present invention, it is possible, for an electronic device such as a notebook PC having a wireless communication function, to compensate the deviations of resonance frequency of antennas caused by errors in mounting of the antennas for individual devices, the difference in the dimension of structures or the like, to match the resonance frequency to the specified central frequency.

6 Claims, 4 Drawing Sheets

[Figure 1]
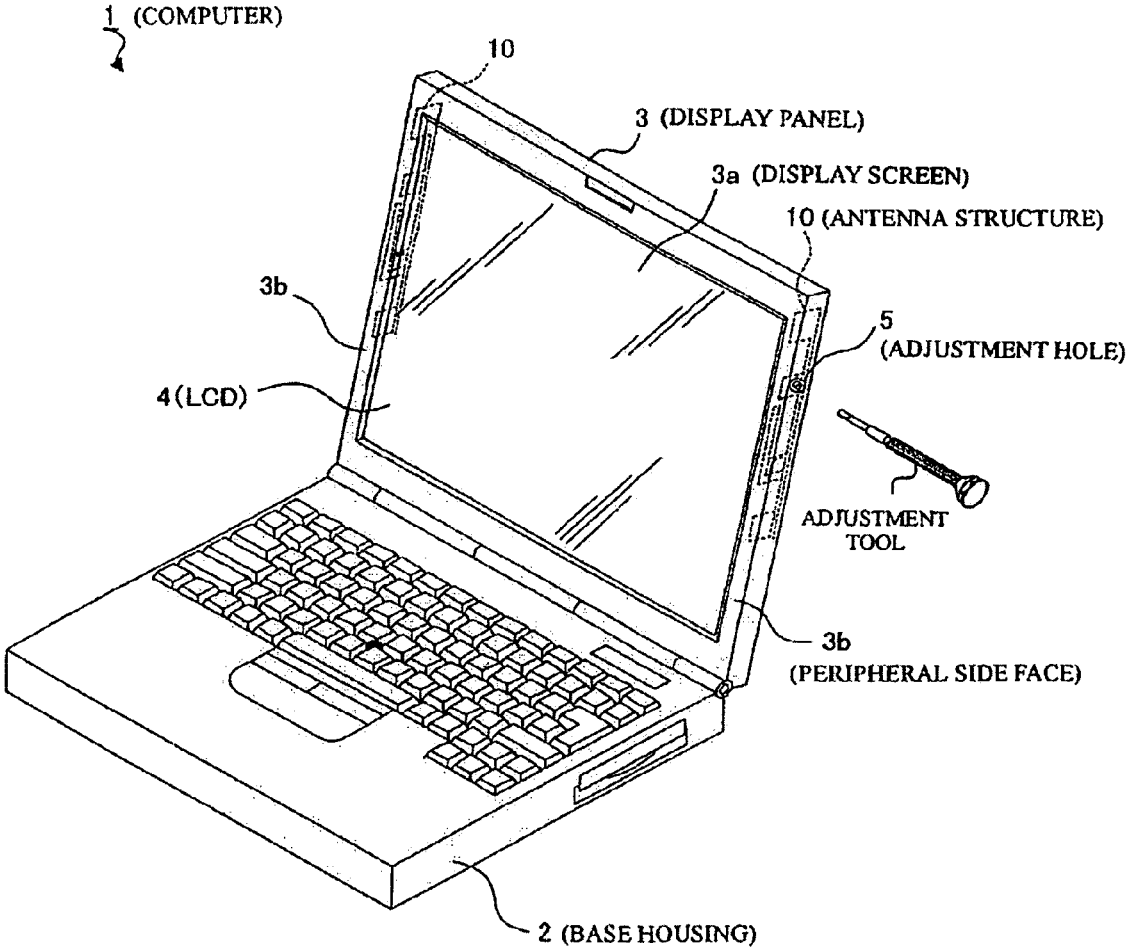

[Figure 2]
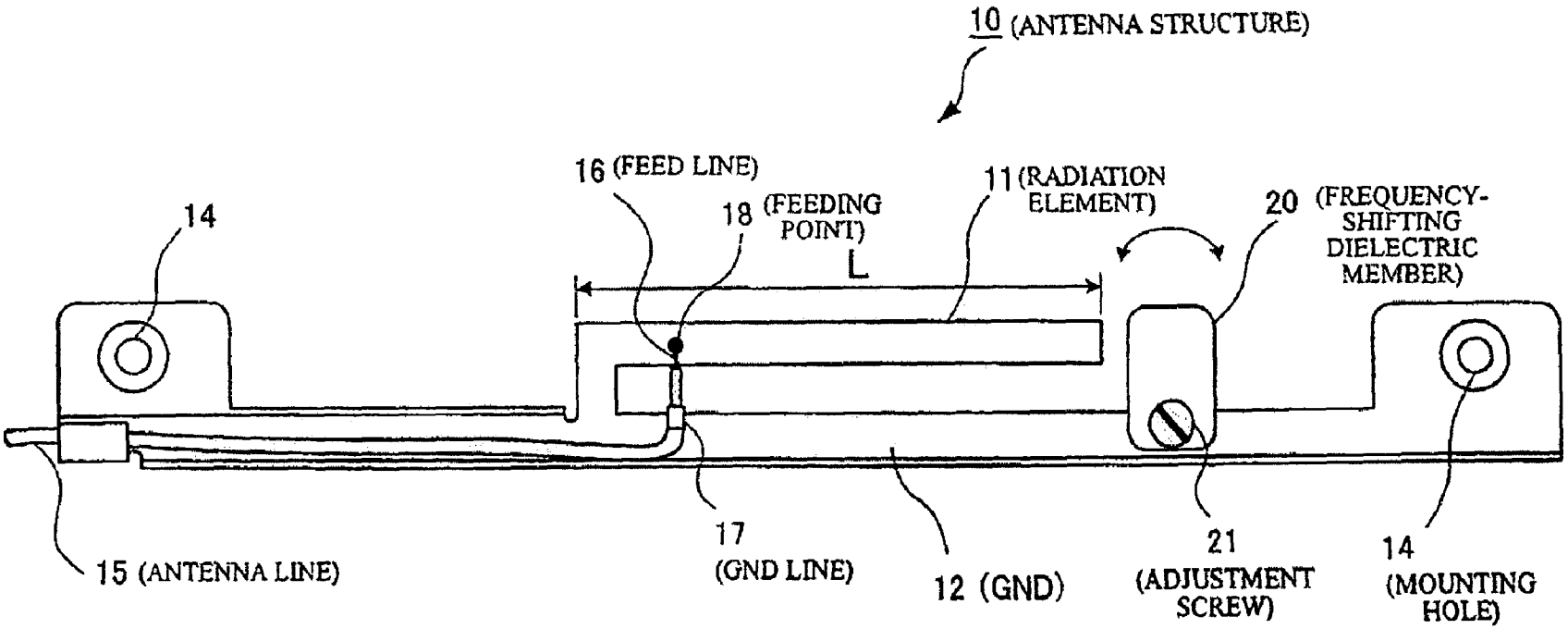

[Figure 3]
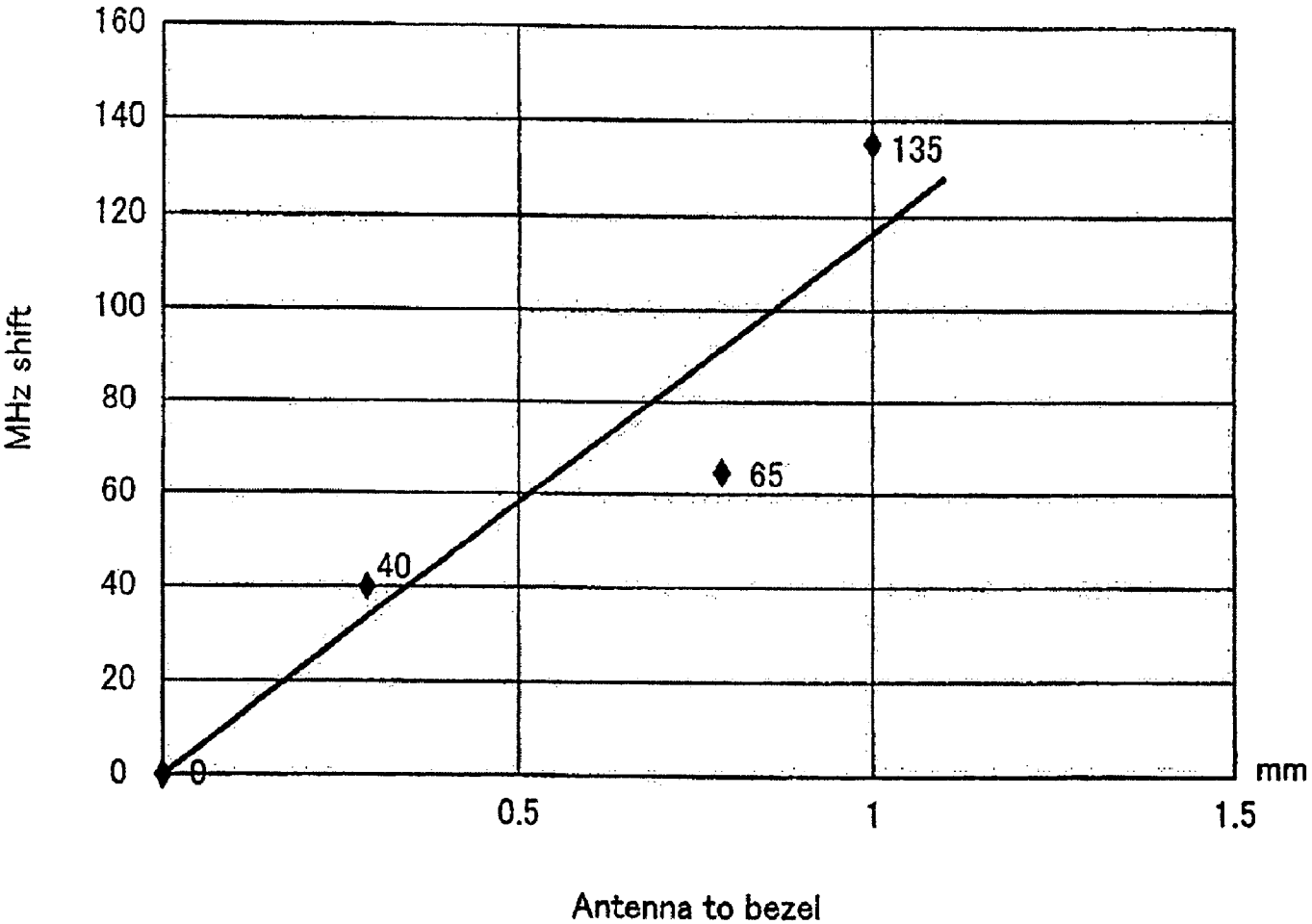

[Figure 4]
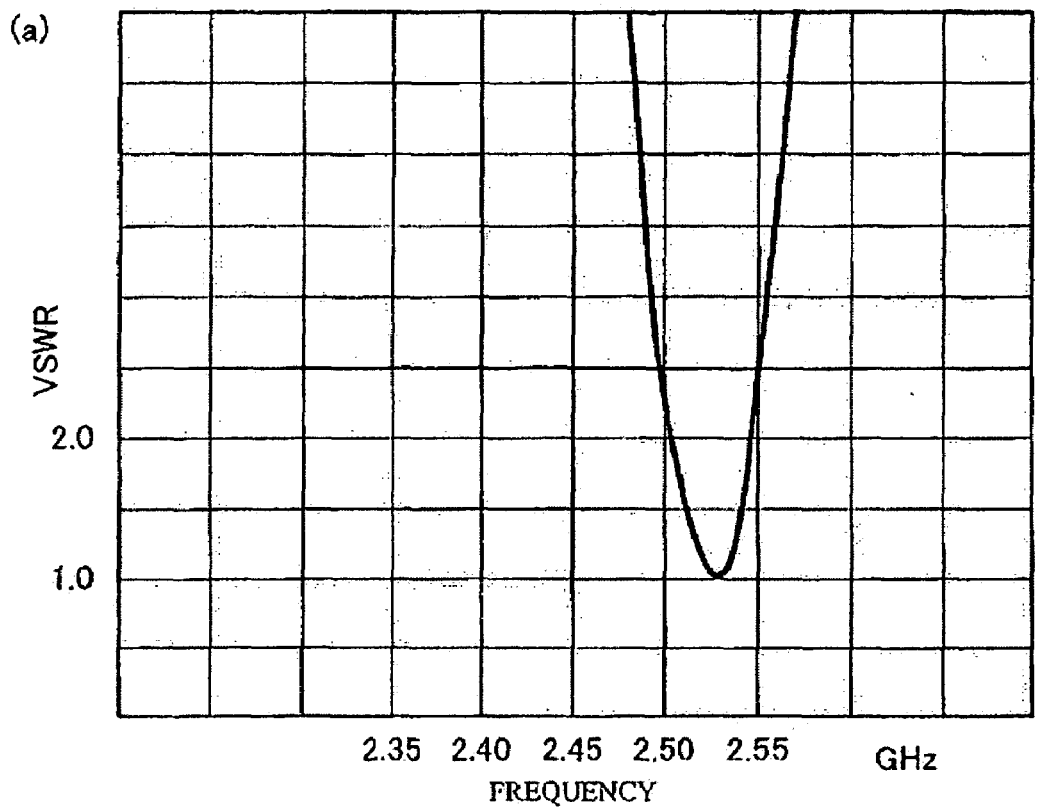
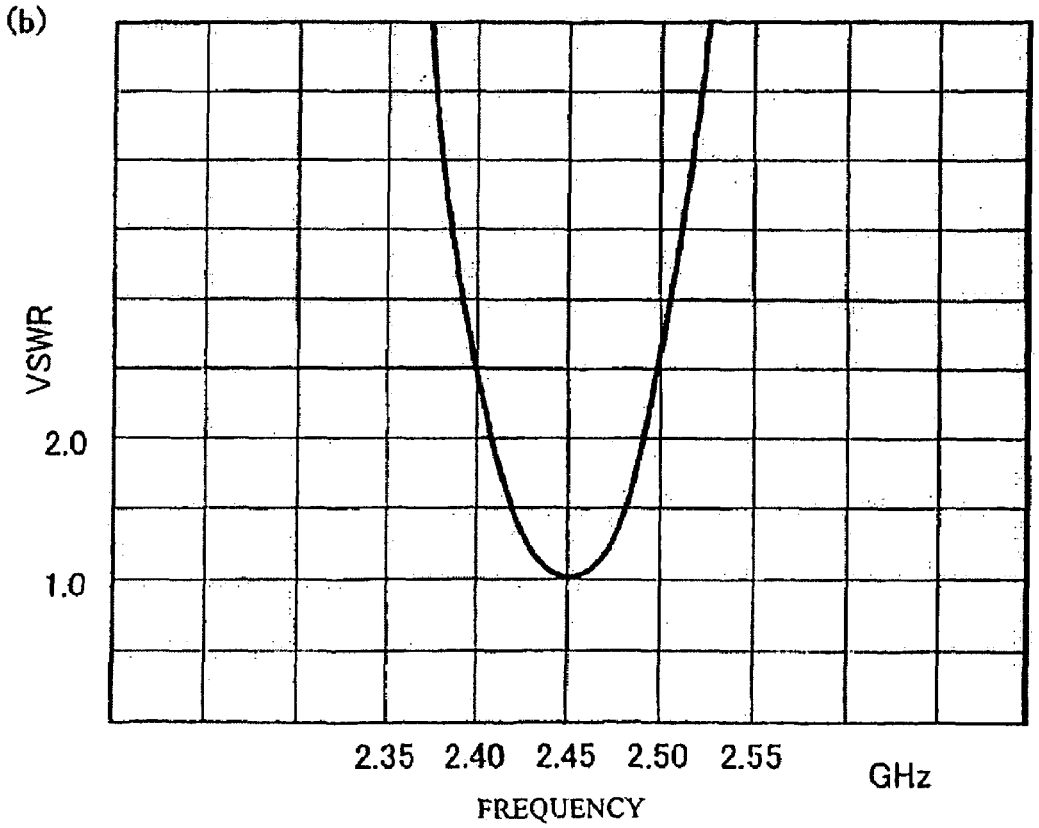

ELECTRONIC DEVICE WITH ANTENNA, ANTENNA STRUCTURE, AND METHOD FOR ADJUSTING ANTENNA OR ELECTRONIC DEVICE

FIELD OF THE INVENTION

The present invention relates generally to electronic devices such as notebook personal computers, and more particularly to electronic devices having therein an antenna for wireless communication.

BACKGROUND OF THE INVENTION

Mobile electronic devices such as cellular phones are increasingly used all over the world, and their communication performance has been much improved. Electronic devices such as notebook-type personal computers (notebook PCs) with wireless communication capability such as wireless LAN or Bluetooth (registered trademark) are also increasingly used. For such wireless communication, there are standard specifications including IEEE802.11b, which achieves a transmission rate of 11 Mbps in the 2.4 to 2.5 GHz band, and IEEE802.11a, which utilizes 5 GHz band (5.15 to 5.825 GHz). An electronic device with wireless communication capability employs a wireless antenna for sending and receiving radio wave (electromagnetic wave) in these bands. An antenna used for such an electronic device may be a whip (rod) antenna, which has even sensitivity in any direction as a non-directional antenna, a dipole antenna, which consists of two antenna elements arranged rectilinearly as wire antennas (line-shape antenna), and an inverted F type antenna, which is a kind of planar antenna.

In a conventional technique disclosed in a publication, for obtaining a high gain of a inverted F type antenna in a desired direction, there is provided a structure that allows a metal member or dielectric member for frequency adjustment to be disposed between an antenna base plate and a plate-shaped F-type antenna radiation element in L-shape, and the position of the metal member or dielectric member is adjusted to obtain a high gain in a desired direction (for example, see Patent document 1). In another disclosed technique, when an antenna is mounted on a notebook PC, the effect of the dielectric constant of a display unit case on the antenna performance is adjusted by adjusting the gap between the antenna and the case, so that the resonance frequency of the antenna is matched with a target, central frequency.

In using a conventional wireless antenna, a frequency shift occurs when it is mounted on a notebook PC system, due to the tolerance of assembly or the tolerance of antenna itself. Such frequency shift occurs since there are a dielectric cover for a liquid crystal display (LCD) and a dielectric frame surrounding the LCD around the antenna element. The occurrence of the frequency shift strongly deviates the resonance frequency from the central frequency of 2.4 to 2.5 GHz, or 2.45 GHz, with a result that desired electromagnetic wave cannot be received and/or it cannot be radiated. This does not cause a serious problem, for example, when there is substantial space for an antenna to be placed that has a wide band covering the frequency shift, or when the antenna itself has a wide band. However, in the case of using an antenna having a narrow band, the frequency deviation significantly affects the performance of the antenna. The frequency deviation may be much worse than the specification of the antenna, resulting in the increased cost for the adjustment of frequency.

In a technique described in Patent Application No. 8-204438, the resonance frequency is changed by varying the capacitance between a radiation element and a metal shield case. Thus, in the technique described in Patent Application No. 8-204438, the capacitance changes depending on the adjustment of the frequency adjustment plate, which causes a problem of a reduced gain even if matching of resonance points is made. Therefore, the technique is not preferable when the antenna is used in a circumstance where it is sensitive to the gain.

In Patent Application No. 2003-37416, adjustment is performed for the effect on antenna, of the dielectric constant of the display unit case to which the antenna is fixed in contact therewith. With the technique of Patent Application No. 2003-37416, one type of antenna can be used for various devices, while error of mounting on a single type of devices cannot be handled. Specifically, devices of a single type have resonant points that are slightly different with each other due to the error in mounting. It is thus difficult, in the technique of Patent Application No. 2003-37416, to handle the deviation of the resonant points due to the error of mounting, the tolerance in size for each device type, or the like.

The present invention is made to solve the above technical problem, and has an object to make it possible to compensate a frequency shift occurring in an electronic device having an antenna.

Another object is to make it possible to perform the adjustment of frequency shift of an antenna after the final assembly of an electronic device.

Yet another object is, in an electronic device having an antenna, to allow the oscillation point to be shifted without substantially changing the capacitance and with avoiding an input on the gain.

The present invention addresses such a need.

SUMMARY OF THE INVENTION

Electronic device with antenna, antenna structure, and a method for adjusting antenna of electronic device is disclosed.

To achieve the above objects, the present invention is an electronic device such as a notebook PC or cellular phone, comprising: a device body, a radiation element for performing reception and/or radiation of electromagnetic wave as an antenna to be equipped with the device body; and a dielectric member placed close to or in contact with the radiation element within the device body, the dielectric member being movable from the outside of the device body to shift the resonance frequency of the antenna.

According to the present invention, it is possible, for an electronic device such as a notebook PC having a wireless communication function, to compensate the deviations of resonance frequency of antennas caused by errors in mounting of the antennas for individual devices, the difference in the dimension of structures or the like, to match the resonance frequency to the specified central frequency, for example.

BRIEF DESCRIPTION OF THE DRAWINGS

FIG. 1 is a view of a computer such as a notebook personal computer (notebook PC);

FIG. 2 is a diagram of an antenna structure to which an embodiment of the present invention is applied;

FIG. 3 shows an example of effects of an antenna; and

FIGS. 4(*a*) and (*b*) show an example of adjusting frequency deviation due to the dispersion among assembled products as an application of an embodiment of the present invention.

DETAILED DESCRIPTION

[Description of Symbols]

1 . . . computer
2 . . . base housing
3 . . . display panel (display panel housing)
4 . . . LCD (liquid crystal display)
5 . . . adjustment hole
10 . . . antenna structure
11 . . . radiation element
12 . . . ground (GND)
14 . . . mounting hole
15 . . . antenna line
16 . . . feed line
17 . . . GND line
18 . . . feeding point
20 . . . frequency-shifting dielectric member
21 . . . adjustment screw The present invention relates generally to electronic devices such as notebook personal computers, and more particularly to electronic devices having therein an antenna for wireless communication. The following description is presented to enable one of ordinary skill in the art to make and use the invention and is provided in the context of a patent application and its requirements. Various modifications to the preferred embodiments and the generic principles and features described herein will be readily apparent to those skilled in the art. Thus, the present invention is not intended to be limited to the embodiments shown, but is to be accorded the widest scope consistent with the principles and features described herein.

To achieve the above objects, the present invention is an electronic device such as a notebook PC or cellular phone, comprising: a device body, a radiation element for performing reception and/or radiation of electromagnetic wave as an antenna to be equipped with the device body; and a dielectric member placed close to or in contact with the radiation element within the device body, the dielectric member being movable from the outside of the device body to shift the resonance frequency of the antenna.

Here, the radiation element may be an inverted F-type antenna; the radiation element may have an end portion; and the dielectric member may be placed close to the end portion of the radiation element, and the distance between at least a part of the dielectric member and the end portion can be adjusted. The electronic device may further comprise a ground that is placed with a predetermined space from the radiation element, and the dielectric member may be mounted on the ground. The dielectric member may be mounted with a screw member and can be rotated around the screw member. An adjustment hole may be provided in an outer wall of the device body, and the dielectric member may be configured so that at least a part of the dielectric member can be moved from the adjustment hole using an adjustment tool. Such a configuration makes it possible to compensate a frequency deviation due to dimension errors of structures such as antennas, errors in mounting of structures, or the like.

In another aspect, an electronic device according to the present invention comprises: a device body; an inverted F-type antenna mounted on the device body; and a dielectric member provided close to an end portion of a radiation element of the inverted F-type antenna, and mounted such that the dielectric constant of the inverted F-type antenna can be changed by adjusting the distance between the dielectric member and the end portion.

Here, the dielectric member may comprise a resin member. The electronic device may further comprise a screw member for fixing the dielectric member, and the distance between the dielectric member and the end portion can be adjusted by rotating the screw member. The electronic device may further comprise a display screen for image and a display panel that has a peripheral side face adjacent to the display screen. The inverted F-type antenna may be mounted on the peripheral side face of the display panel. The dielectric member can be adjusted from the outside of a cover that covers the peripheral side face of the display panel.

The present invention also provides an antenna structure disposed within an electronic device, comprising: a radiation element for performing reception and/or radiation of electromagnetic wave; and a dielectric member placed close to or in contact with the radiation element, the dielectric member being configured so that at least a part thereof can be moved from the outside of the electronic device after the radiation element is mounted within the electronic device. Here, the radiation element may have an end portion, and the dielectric member may be placed close to the end portion of the radiation element, and the distance between the dielectric member and the end portion can be adjusted.

Here, the antenna structure may further comprise: a ground that is placed with a predetermined space from the radiation element; and a screw member for mounting the dielectric member to the ground, and at least a part of the dielectric member can be moved by rotating the screw member.

In another aspect as a method, the present invention is an antenna adjustment method for adjusting an antenna mounted on an electronic device, comprising: providing a dielectric member close to a radiation element for performing reception of electromagnetic wave and/or radiation of electromagnetic wave by the antenna; and after the antenna is mounted on the electronic device, adjusting the distance between at least a part of the dielectric member and the radiation element from the outside of the electronic device to change the dielectric constant of the antenna, thereby shifting the resonance frequency of the antenna mounted on the electronic device to a desired central frequency.

Preferably, the dielectric member may be rotatably disposed, and the dielectric member may be rotated from the outside of the electronic device to adjust the distance between at least a part of the dielectric member and the radiation element, so that the resonance frequency of the antenna can be matched to the specified central frequency for every assembled device.

FIG. 1 is a view of the appearance of a computer 1 such as a notebook personal computer (notebook PC). This embodiment of the present invention is applied to electronic devices such as notebook PCs. However, the embodiment is not limited to notebook PCs, and can also be applied to other electronic devices such as desktop PCs with radio communication functions and cellular phones. The computer 1 in FIG. 1 comprises a base housing 2 that contains a system board and peripherals and has a keyboard disposed thereon, and display panel (display panel housing) 3 that has in its inner side an LCD (liquid display device) 4 embedded substantially in the center thereof. The display panel 3 comprises an image display screen 3*a* for displaying an image, and a peripheral face 3*b* that is adjacent to the display screen 3*a*, which is covered by a cover of a resin member. The base housing 2 and the display panel 3 are pivotably hinged at the rear edge.

Antenna structures 10 for performing reception/radiation of electromagnetic wave at a predetermined frequency are provided at opposing sides of the peripheral face 3*b* of the display panel 3. The antenna structures 10 are fixed with screws on a frame portion of the peripheral face 3*b* of the display panel 3. An antenna line (described later) is connected to electromagnetic wave/signal conversion circuit, amplifiers and signal processors that are provided in the base housing 2 (not shown). In this embodiment, adjustment holes 5 are provided through the opposing sides of the cover of the display panel 3 at the positions of adjustment screws (described later) provided in the antenna structures 10. The adjustment of frequency shift of the antenna can be performed by inserting an adjustment tool such as a flathead screw driver into the adjustment hole 5. The adjustment hole 5 is preferably closed after the final assembly of the computer 1 and then the adjustment are completed. Alternatively, the computer 10 may be configured with tamper screws which requires the use of a special wrench, so that unauthorized users cannot perform the modification. The antenna 10 may be mounted on the top face of the peripheral of the display panel 3 or on the base housing 2 instead of the peripheral side face 3*b* of the display panel 3. Note that the antenna should be placed as high as possible to increase the sensitivity of the antenna and it is thus preferable to provide the antenna on the peripheral side face 3*b* or the top face of the display panel 3.

FIG. 2 is a diagram of the antenna structure 10 to which the embodiment is applied. The antenna structure 10, which is an inverted F-type antenna in this example, comprises a radiation element 11 for receiving and radiating electromagnetic wave, and a ground (GND) 12 that is fixed to the frame portion of the display panel 3 to be grounded. Mounting holes 14 provided in the sides of the GND 12 are used for fixing the GND 12 to the frame portion of the display panel 3. The distance between one end and the other end of the radiation element 11 shown in FIG. 2 (the length L) is specified to be a length of ¼λ where λ represents the wavelength of electromagnetic wave for transmission/reception. For example, in the case of receiving electromagnetic wave of frequency of 2.45 GHz, the ¼λ is about 30.6 mm. The antenna structure 10 is connected through antenna line 15 to the electromagnetic wave/signal conversion circuit and so on. The antenna line 15 comprises a feed line 16 and a GND line 17, with the feed line 16 connected to the radiation element 11 and the GND line 17 connected to the GND 12. The connecting portion of the feed line 16 constitutes a feeding point 18 for the radiation elements 11. The positions of these components in the antenna structure 10 are specified so that the impedance at the feeding point 18 is, for example, 50 Ω.

The antenna structure 10 of this embodiment further comprises a frequency-shifting dielectric member 20 consisting of a dielectric for shifting the frequency center, in the proximity to the distal end of the radiation element 11. In other words, a side end portion of the frequency-shifting dielectric member 20 is positioned close to the distal end of the radiation element 11. The frequency-shifting dielectric member 20 is fastened with an adjustment screw 21 (a screw member) at a predetermined position in the GND 12. The frequency-shifting dielectric member 20 is composed of a resin such as ABS and has a thickness of about 2 to 3 mm and a shape of about 5 mm by 6 mm. The frequency-shifting dielectric member 20 is attached to the GND 12 while being pressed thereto at a predetermined pressure by the adjustments screw 21. Actually, the elasticity of the resin provides the fastening at the predetermined pressure. The frequency-shifting dielectric member 20 is designed so that, in the situation of FIG. 2, the distance between the distal end of the radiation element 11 and the left side of the frequency-shifting dielectric member 20 (the side closer to the radiation element 11) is about 5 mm. The frequency-shifting dielectric member 20 can be rotated in the direction indicated by the arrow with the rotation of the adjustment screw 21. The left rotation (counter-clockwise rotation) of the adjustment screw 21 moves the frequency-shifting dielectric member 20 (a part of the frequency-shifting dielectric member 20) toward the radiation element 11. The right rotation (clockwise rotation) of the adjustment screw 21 moves the frequency-shifting dielectric member 20 (a part of the frequency-shifting dielectric member 20) away from the radiation element 11. In this embodiment, the adjustment hole 5 is provided through the display panel 3 of the computer 1, as shown in FIG. 1. By inserting an adjustment tool in the adjustment hole 5, it is possible to rotate the adjustment screw 21 from the outside of the computer 1 after the antenna structure 10 is mounted on the device's main body.

FIG. 3 shows an example of an effect of the antenna dielectric. The example of FIG. 3 shows experimental values obtained in the case of using a typical antenna represented by the antenna structure 10. In the figure, the axis of abscissas represents the position of the antenna mounted, which means the distance (displacement: mm) between the antenna and a resin cover provided to the display panel 3. The axis of ordinate represents the frequency shift (MHz). It can be seen, from the example of FIG. 3, that when the antenna is moved toward the resin cover (dielectric) and the displacement thus decreases, the frequency shift decreases, and that when the antenna is moved away from the resin cover (dielectric) and the displacement thus increases, the frequency shift increases. Thus, when the dielectric member is moved toward the radiation element 11, which is an element of the antenna structure 10, the frequency shift can be reduced. Thorough experimental study by the inventors proved that the move of the frequency-shifting dielectric member 20 toward the radiation element 11 by, for example, 1 mm causes the shift of frequency center of the antenna structure 10 to several tens MHz. Accordingly, in this embodiment, the left rotation (counter-clockwise rotation) of the adjustment screw 21 moves the frequency-shifting dielectric member 20 toward the radiation element 11 in order to shift the frequency to lower side, while the right rotation (clockwise rotation) of the adjustment screw 21 moves the frequency-shifting dielectric member 20 away from the radiation element 11 in order to shift the frequency to higher side.

FIGS. 4(*a*) and (4*b*) show, as an application of the embodiment, examples of adjustment of frequency deviation due to the difference between assembled products. FIG. 4(*a*) shows a situation where no adjustment of frequency deviation is performed after the assembly, and FIG. 4(*b*) shows a situation where adjustment of frequency deviation has been performed by the rotation of the adjustment screw 21. In each figure, the axis of abscissas represents the frequency (GHz) and the axis of ordinate represents the voltage standing wave ratio (VSWR). In the example of FIG. 4(*a*), the frequency center is at about 2.55 GHz, which is out of the specified frequency of IEEE802.11b, 2.4 to 2.5 GHz. Then, the adjustment screw 21 is rotated to move the frequency-shifting dielectric member 20 gradually toward the radiation element 11, so that the frequency can be adjusted to be at 2.45 Hz, the specified central frequency, as shown in FIG. 4 (*b*).

As describe above in detail, in this embodiment, a resin member is used as a dielectric member, which is rotated by a precise screw driver or the like to change the position of the dielectric constant of the antenna, thereby shifting the antenna frequency. Specifically, a small resin part acting as dielectric is provided around an antenna element, and the resin part is moved by operation from the outside of the assembled device, thereby matching the resonance frequency in frequency characteristics of the antenna to the specified central frequency for every device. Accordingly, it is possible, after the final assembly of an electronic device, to adjust the frequency shift that is caused by the tolerance in assembly or tolerance of the antenna itself when the antenna is mounted on the electronic device. Moreover, according to this embodiment it is possible to change the position of the dielectric constant while limiting the influence on the gain and not changing the capacitance between the radiation element 111 and the GND 12.

In the embodiment described above, the antenna structure 10 of FIG. 2 is a metal plate as an example. However, the antenna structure 10 may be a substrate antenna. In a substrate antenna, for example, lines are formed of copper film with features corresponding to the radiation element 11 and the ground (GND) 12 of the antenna structure 10 shown in FIG. 2, and attached to an insulation plate (Bakelite, epoxy resin, or the like) with a thickness of about 1 to 2 mm. The thickness of the copper film is, for example, about 30 to 40 μm. In this antenna comprising the lines of copper film, a rotatable resin member is placed near the radiation element (near the distal end) and attached to the substrate (insulation plate) with a screw member or the like. The substrate antenna is mounted on the device body such that the thread ridge of the screw member is positioned at the portion of the adjustment hole 5 of the computer 1 as shown FIG. 1. As shown above, the antenna may have another structure different than the structure of the antenna structure 10 in FIG. 2. The present invention may be applied, instead of to an inverted F-type antenna, to a whip (rod) antenna, a dipole antenna, a helical antenna, or a slot antenna, or the like. In the embodiment described above, the antenna of IEEE802.11b is used, but the present invention can be applied to another antenna such as an antenna of Bluetooth or IEEE802.11a.

In the example shown in FIG. 2, a side end portion of the frequency-shifting dielectric member 20 is positioned close to an end of the radiation element 11. However, the frequency-shifting dielectric member 20 may be made contact with the radiation element 11 after the rotation thereof. Shifting of the frequency may be performed by moving the frequency-shifting dielectric member 20 from a position at which the contact is made in advance. Note that a change in capacitance may occur because of the increased area where the frequency-shifting dielectric member 20 is made contact with the radiation 11. Therefore, energy change should be noticed.

The present invention can be applied to various electronic devices having antennas, such as notebook personal computers (notebook PCs), cellular phones, or mobile wireless devices.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. An electronic device comprising:

a device body;

an inverted F-type antenna mounted on the device body;

a dielectric member provided close to an end portion of a radiation element of the inverted F-type antenna, the dielectric member being mounted such that the dielectric constant of the inverted F-type antenna is changeable by adjusting the distance between the dielectric member and the end portion;

a ground, wherein the dielectric member is at a predetermined position on the ground, and wherein at least a part of the dielectric member can be rotated; and a display screen for image and a display panel that has a peripheral side face adjacent to the display screen, wherein the inverted F-type antenna is mounted on the peripheral side face of the display panel, and wherein the dielectric member is adjustable from the outside of a cover that covers the peripheral side face of the display panel.

2. The electronic device according to claim 1, wherein the dielectric member comprises a resin member.

3. The electronic device according to claim 1, further comprising a screw member for fixing the dielectric member, wherein the distance between the dielectric member and the end portion is adjustable by rotating the screw member.

4. An antenna structure disposed within an electronic device, comprising:

a radiation element for performing reception and/or radiation of electromagnetic wave;

a dielectric member placed close to or in contact with the radiation element, the dielectric member being configured so that at least a part thereof can be moved from the outside of the electronic device after the radiation element is mounted within the electronic device;

a ground, wherein the dielectric member is at a predetermined position on the ground, and wherein at least a part of the dielectric member can be rotated; and a screw member for mounting the dielectric member on the ground, wherein the ground that is placed with a predetermined space from the radiation element, wherein at least a part of the dielectric member can be moved by rotating the screw member.

5. The antenna structure according to claim 4, wherein the radiation element has an end portion;

the dielectric member is placed close to the end portion of the radiation element, and the distance between the dielectric member and the end portion is adjustable.

6. An antenna structure disposed within an electronic device, comprising:

a radiation element for performing reception and/or radiation of electromagnetic wave;

a dielectric member placed close to or in contact with the radiation element, the dielectric member being configured so that at least a part thereof can be moved from the outside of the electronic device after the radiation element is mounted within the electronic device;

a ground, wherein the dielectric member is at a predetermined position on the ground, and wherein at least a part of the dielectric member can be rotated; and a screw member for mounting the dielectric member on the ground, wherein the ground that is placed with a predetermined space from the radiation element, wherein at least a part of the dielectric member can be moved by rotating the screw member.

* * * * *